US006116805A

United States Patent [19]

Gertz

[11] Patent Number: 6,116,805

[45] Date of Patent: Sep. 12, 2000

[54] CRASH ATTENUATOR WITH A ROW OF COMPRESSIBLE HOOPS

[76] Inventor: David C. Gertz, 240 Avenue Vista Montana , #12H, San Clemente, Calif. 92672

[21] Appl. No.: 09/073,277

[22] Filed: May 5, 1998

Related U.S. Application Data

[60] Provisional application No. 60/045,588, May 5, 1997.

[51] Int. Cl.[7] ..... A01K 3/00; E01F 15/00

[52] U.S. Cl. ..... 403/13.1; 404/6

[58] Field of Search ..... 256/1, 13.1; 404/6, 404/7, 8, 9

[56] References Cited

U.S. PATENT DOCUMENTS

| | | | |
|---|---|---|---|
| 3,211,260 | 10/1965 | Jackson . | |
| 3,211,620 | 10/1965 | Henkin et al. . | |
| 3,307,832 | 3/1967 | Van Zelm et al. . | |
| 3,377,044 | 4/1968 | Jackson et al. . | |
| 3,643,924 | 2/1972 | Fitch . | |
| 3,674,115 | 7/1972 | Young et al. . | |
| 3,944,187 | 3/1976 | Walker . | |
| 4,321,989 | 3/1982 | Meinzer . | |
| 4,330,106 | 5/1982 | Chisolm . | |
| 4,352,484 | 10/1982 | Gertz et al. . | |
| 4,399,980 | 8/1983 | van Schie . | |
| 4,407,484 | 10/1983 | Meinzer . | |
| 4,452,431 | 6/1984 | Stephens et al. . | |
| 4,674,911 | 6/1987 | Gertz . | |
| 4,784,515 | 11/1988 | Krage et al. . | |
| 5,022,782 | 6/1991 | Gertz et al. . | |
| 5,112,028 | 5/1992 | Laturner . | |
| 5,660,496 | 8/1997 | Muller et al. . | |
| 5,733,062 | 3/1998 | Oberth et al. . | |
| 5,791,812 | 8/1998 | Ivey . | |
| 5,851,005 | 12/1998 | Muller et al. | 256/13.1 |

FOREIGN PATENT DOCUMENTS

| | | | |
|---|---|---|---|
| 0149567 | 7/1985 | European Pat. Off. | 256/13.1 |

OTHER PUBLICATIONS

Windbreakers Non–metallic Channelizing Device; Trafcon Industries Inc.; Patent Pending.

Big Foot Self Ballasting Vertical Channelizer; Protection Services Inc. a Division of Stabler Companies inc.; Nov. 1995.

DDK Barricade; What Makes DDK The Best?; Service Signing L.C., Cedar Falls Iowa.

Impact Recovery Systems; Flexible Traffic Control Products; San Antonio Texas.

The Gripper Delineator Post; Lifegard; Plastic Safety Systems, Inc., Cleveland, Ohio 44120.

Rubber Tough Flexible Signpost Assemblies; Safe–Hit Corporation; Hayward, CA 94545.

(List continued on next page.)

*Primary Examiner*—Lynne H. Browne
*Assistant Examiner*—John R. Cottingham
*Attorney, Agent, or Firm*—Stout, Uxa, Buyan & Mullins, LLP; Donald E. Stout

[57] ABSTRACT

An energy absorbing guardrail crash attenuator system comprises a row of compressible hoops with left and right border panels extending along at least a portion of the row. Adjacent hoops in the row are attached, with the proximate portions of adjacent hoops defining connection regions. The border panels extend along the left and right sides of the row of hoops, with the panels being separated by a panel distance. The left and right border panels have opposing portion pairs that are restricted in their movement such that the pairs do not move more than the panel distance apart during compression of one or more of the hoops. At least one of the opposing portion pairs is disposed about one of the connection regions. In an aspect of the attenuation system, the hoops have left and right outwardly bowing curved panels having front ends oriented toward the row front and back ends oriented toward the row back. Adjacent hoops are connected to each other with flexible joints that also connect the curved panels front ends and the curved panels back ends, respectively. In an aspect of the attenuation system, the front end of the row of compressible hoops extends into an array of containers of particulate mass, such that the attenuation system performs gating and redirecting functions.

44 Claims, 10 Drawing Sheets

OTHER PUBLICATIONS

Roadway Safety Service, Inc.; React350 Reusable Energy Absorbing Crash Terminal; Ronkonkoma, NY 11779.
Saving Lives by Design: Energy Absorption Systems, Inc.; Chicago, IL 60601–2076.
Dragnet Vehicle Arresting Barrier; Roadway Safety Service, Inc.; Wauconda, IL 60084.
David R. Lewis: Highway Safety Consultant; Girard, Ohio 44420; SYRO, Inc. Dallas TX 75207.
NCHRP Syntheses 205; Performance and Operational Experience of Crash Cushions; Transportation Research Board; National Academy Press; Washington, D.C. 1994.
Paper No. 980765; NHCHRP Report 350 Compliance Testing of BEST System; by Brian G. Pfeifer and Dean L. Sicking; Trnsportation Research Board; Washington, D.C. 1998.

Paper No. 980352; Design of the SKT–350 Using LS–DYNA3D; by John D. Reid and Dean L. Sicking; Transporation Research Board; Washington, D.C. 1997.

Paper No. 980614; Development of a Sequential Kinking Terminal for W–Beam Guardrails; Dean L. Sicking, John D. Reid and John R. Rohde; Transportation Research Board; Washington, D.C. 1997.

CRASH ATTENUATOR WITH A ROW OF COMPRESSIBLE HOOPS

CROSS REFERENCES TO RELATED APPLICATIONS

This application claims the benefit of U.S. Provisional Application No. 60/045,588, filed May 5, 1997. This application is related to Patent Application entitled Crash Attenuator of Compressible Sections, filed May 5, 1998.

BACKGROUND OF THE INVENTION

1. Field of the Invention

This invention relates to an improved crash attenuator for protecting a vehicle from impacting a rigid backup. More specifically, this invention relates to an improved crash attenuator that redirects or gates and redirects vehicles.

2. Description of the Related Art

Impact attenuation devices are often used to prevent the vehicles from impacting a rigid backup. A rigid backup may be any relatively inflexible item, stationary or portable, that would be undesirable to impact. An example of a rigid backup is a toll booth median between two lanes of traffic.

Impact attenuation devices perform gating functions, redirecting functions or both. The gating function absorbs impact energy through a vehicle penerating the gating device or portion of the attenuator. Vehicles traveling toward the rigid backup in the axial direction of the attenuator impact the gating device or portion and slow down through the length of the device. However, vehicles approaching the "coffin corner" of the rigid backup from an angle off of the axial direction of the attenuator do not have full length of the gating device or portion to absorb impact energy. The coffin corners are the front corners of the rigid backup. Without the impact energy being absorbed, the full force of the vehicle impacts the coffin corner, resulting in catastrophic damage.

To inhibit vehicles impacting the coffin corner of a rigid backup, a redirecting device or portion redirects the vehicle away from the coffin corner. To accomplish this, the redirecting device or portion must be designed to withstand lateral impact.

One approach to such impact attenuation devices employ an axially collapsible frame having compression resistant elements disposed one behind the other in the frame. Young U.S. Pat. No. 3,674,115 provides an early example of one such system. This system includes a frame made up of an axially oriented array of segments, each having a diaphragm extending transverse to the axial direction and a pair of side panels positioned to extend rearwardly from the diaphragm. Energy absorbing elements (in this example water filled flexible cylindrical elements) are mounted between the diaphragms. During an axial impact the diaphragms deform the energy absorbing elements, thereby causing water to be accelerated to absorb the kinetic energy of the impacting vehicle. Axially oriented cables are positioned on each side of the diaphragms to maintain the diaphragms in axial alignment during an impact.

Other examples of such crash barriers are shown in Walker U.S. Pat. No. 3,944,187 and Walker U.S. Pat. No. 3,982,734. These systems also include a collapsible frame made up of an axially oriented array of diaphragms with side panels mounted to the diaphragms to slide over one another during an axial collapse. The barriers of these patents use a cast or molded body of vermiculite or similar material or alternately loosely associated vermiculite particles to perform the energy absorption function. Obliquely oriented cables are provided between the diaphragms and ground anchors to maintain the diaphragms in axial alignment during a lateral impact.

Gertz U.S. Pat. No. 4,352,484 discloses an improved crash barrier that utilizes an energy absorbing cartridge made up of foam filled hexagonal lattices arranged to shear into one another in response to the compression forces applied to the energy absorbing cartridge by an impacting vehicle.

Stevens U.S. Pat. No. 4,452,431 shows yet another collapsible crash barrier employing diaphragms and side panels generally similar to those described above. This system also uses axially oriented cables to maintain the diaphragms in axial alignment, as well as breakaway cables secured between the front diaphragm and the ground anchor. These breakaway cables are provided with shear pins designed to fail during an axial impact to allow the frame to collapse. The disclosed crash barrier is used with various types of liquid containing and dry energy absorbing elements.

VanSchie U.S. Pat. No. 4,399,980 discloses another similar crash barrier which employs cylindrical tubes oriented axially between adjacent diaphragms. The energy required to deform these tubes during an axial collapse provides a force tending to decelerate the impacting vehicle. Cross-braces are used to stiffen the frame against lateral impacts, and a guide is provided for the front of the frame to prevent the front of the frame from moving laterally when the frame is struck in a glancing impact by an impacting vehicle.

All of these prior art systems are designed to absorb the kinetic energy of the impacting vehicle by compressively deforming an energy absorbing structure. Because of the potential instability of compressive deformation, these systems use structural members to resist side forces that develop from compression loading. Furthermore, all use sliding side panels designed to telescope past one another during an impact. Because such sliding side panels must slide past one another during an axial impact, they have a limited strength in compression. This can be a disadvantage in some applications.

Another prior art system known as the Dragnet System places a net or other restraining structure transversely across a roadway to be blocked. The two ends of the net are connected to respective metal ribbons, and these metal ribbons pass through rollers that bend the ribbons as they pay out through the rollers during a vehicle impact. The energy required to deform these ribbons results in a kinetic energy dissipating force which decelerates the impacting vehicle. The general principle of operation of the metal deforming rollers is shown for example in Jackson U.S. Pat. Nos. 3,211,260 and 3,377,044 as well as Vanzelm U.S. Pat. No. 3,307,832. The Dragnet System utilizes the metal ribbons in tension, but it is not well suited for use alongside a roadway because metal bending systems are positioned on both sides of the roadway, and the net or other obstruction extends completely across the roadway.

Krage U.S. Pat. No. 4,784,515 describes a collapsible guard rail end terminal that utilizes a wire cable extending through grommets in legs of the end terminal. The side panels of the end terminal are mounted to slide over one another when struck axially. When the end terminal collapses during an impact, the legs may be rotated such that the grommets work the cable and create a frictional force on the cable. However, the magnitude of the resulting retarding forces is highly variable, due to the variable and unpredictable rotational positions of the legs during the collapse.

An Advanced Dynamic Impact Extension Module (ADIEM)—11 of Syros, Inc. provides a system with both gating and redirecting portions. An initial gating section comprises a row of lightweight crushable concrete modules that are placed on a ramp increasing in height toward a rigid backup. The gating portion of the attenuator is the row of modules. A vehicle impacting the modules has the impact force absorbed as the modules break apart. Vehicles approaching more from the side are redirected by the ramp. While the ramp prevents the vehicle from impact the coffin corner, the redirecting ramp is very unforgiving in that it does not absorb energy.

Thus, a need exists for a simple, inexpensive attenuation system that absorbs energy as it redirects vehicles away from the coffin corners. A need also exists for a simple, inexpensive system that performs both gating and redirecting functions.

SUMMARY OF THE INVENTION

According to the present invention, an energy absorbing guardrail crash attenuator system comprises a row of compressible hoops with left and right border panels extending along at least a portion of the row. Adjacent hoops in the row are attached, with the proximate portions of adjacent hoops defining connection regions. The border panels extend along the left and right sides of the row of hoops, with the panels being separated by a panel distance. The left and right border panels have opposing portion pairs that are restricted in their movement such that the pairs do not move more than the panel distance apart during compression of one or more of the hoops. At least one of the opposing portion pairs is disposed about one of the connection regions.

In an aspect of the invention, the left and right border panels extend from the row front to the row back. Further, the opposing portion pairs are disposed about the row front, the row back, and the connection regions.

In an aspect of the invention, one or more sets of one or more cross members extend between and attach one or more opposing portion pairs. respectively. Further, the cross members may comprise rods, bars, or strips.

In an aspect of the invention, the border panels have bending portions located between the opposing portion pairs. Further, the bending portions have been weakened to facilitate one or more of the bending portions to bend outwardly during compression of hoops adjacent to the bending portions. More specifically, the border panels comprise contact regions located midway between opposing portions with the weaknesses in the bending portions occurring at the contact regions. The weaknesses may be holes through the border panels at the contact region. The weaknesses may also be embossed ribs extending toward the hoops. The contact regions are connected to the adjacent hoops with pull-through bolts in an aspect of the invention. Weaknesses may also exist at the opposing portion pairs. In an aspect of the invention, the opposing portion pair weaknesses are indented vertical ribs.

In an aspect of the invention, the hoops have left and right outwardly bowing curved panels having front ends oriented toward the row front and back ends oriented toward the row back. Adjacent hoops are connected to each other with flexible joints that also connect the curved panels front ends and the curved panels back ends, respectively. In an aspect of the invention adjacent flexible joints of adjacent hoops are attached. In another aspect of the invention, each hoop has an axial length along the row axis that is longer than a hoop cross-axial length across the row axis.

Further aspects of the invention have a nose disposed in front of the row front and/or have the row back connected to a rigid backup. Aspects of the invention encompass a portable rigid backup. Portable and stationary rigid backups have left and right border panels attached to the left and right sides of the rigid backup. Other aspects of the invention have contours of the left and right rigid backup sides that complement contours of the left and right border panels.

Aspects of the invention have hoops, border panels, and left and right rigid backup sides comprising w-beam guardrails or thrie-beam guardrails.

Aspects of the invention use an axial movement guide to restrict lateral movement of the row of hoops.

An aspect of the invention has a gating device for controlled penetration by a vehicle. The gating device has a first portion into which the row front extends and a second portion that extends from the first portion and away from the row of hoops along the row axis. The gating device may be an array of containers holding particulate mass, such as sand barrels. The row of hoops may also have a pointed nose that extends from the row front.

DETAILED DESCRIPTION OF THE PREFERRED EMBODIMENTS

Figure 1:
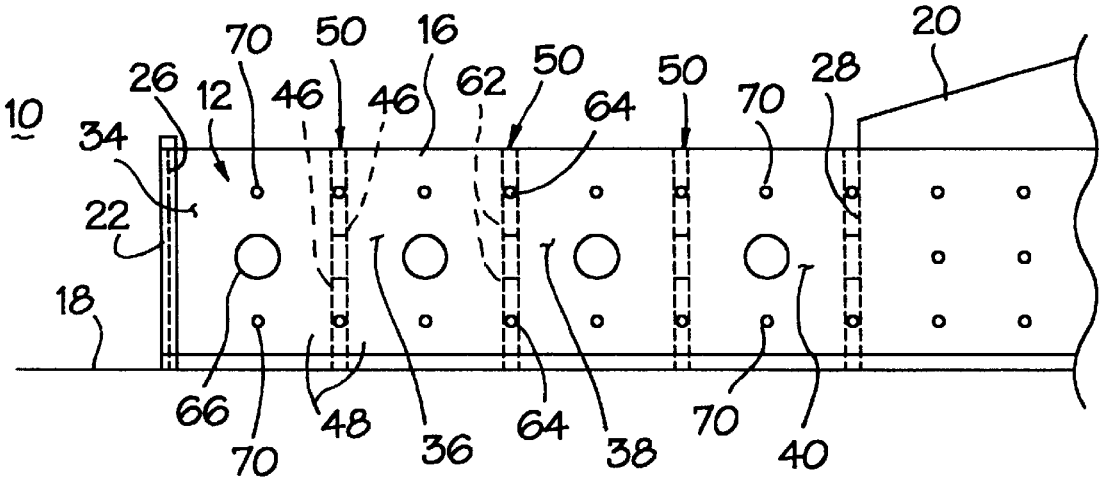
FIG. 1 shows a side view of an attenuator according to an embodiment of the invention.
Figure 2:
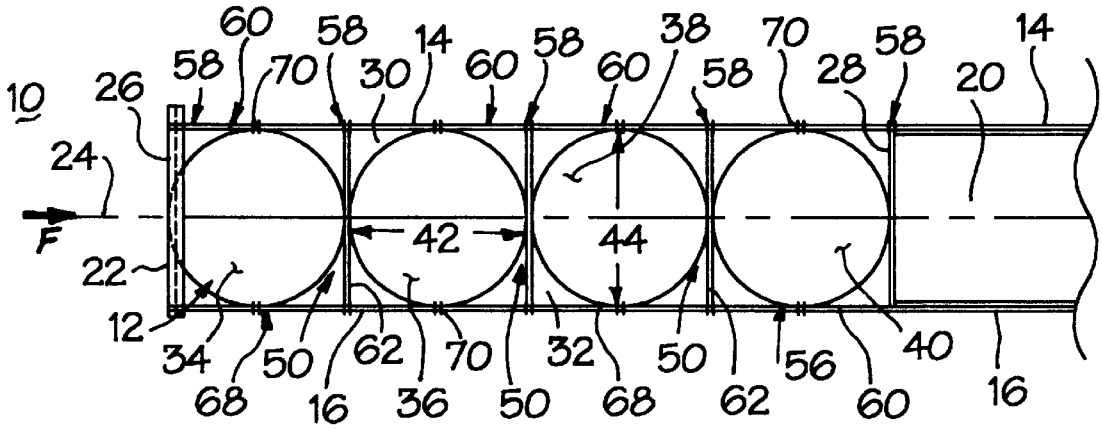
FIG. 2 shows a top view of the attenuator shown in FIG. 1.

Referring now to the figures, wherein like reference numbers refer to like elements throughout the figures, and referring specifically to FIGS. 1 and 2, an energy absorbing guardrail crash attenuator 10 comprises a row of hoops 12, and left and right border panels 14 and 16. The attenuator 10 is shown on a surface 18, extends from a rigid backup 20, and terminates in a nose 22.

The row of hoops 12 has a row axis 24, and a row front 26 and a row back 28 that intersects the row axis. The row front 26 is shown on the left side of FIGS. 1 and 2 and is located distal to the rigid backup 20. The row back 28 is shown on the right side of FIGS. 1 and 2 and is adjacent to the rigid backup 20. The row 12 has a left side 30 shown at the top of FIG. 2 and a right side 32 shown at the bottom of FIG. 2.

The row of hoops 12 is comprised of hoops 34, 36, 38, and 40. In the shown embodiment of the invention, the hoops 34–40 are round. As such, they have equal axial lengths 42 and cross axial lengths 44. Other embodiments of the invention may have lengths 42 and 44 being unequal, or may have varying lengths 42 and/or 44.

The adjacent hoops 34–40 are attached by bolts 46. Other embodiments of the invention may have other connection means for attaching adjacent hoops, such as welding. The bolts 46 and the proximate hoop portions 48 define connection regions 50.

The left and right border panels 14 and 16 are adjacent to the left and right sides 30 and 32 of the row 12. Embodiments of the invention may have the border panels 14 and 16 extending over a portion of the left and right sides 30 and 32 of the row 12. The border panels 14 and 16 are separated by a panel distance 56. The panel distance 56 is equal to or greater than the width of the row 12 at any point. Other embodiments of the invention may have varying panel distances 56 along the length of the row 12.

The left and right border panels 14 and 16 have opposing portion pairs 58 and bending portions 60. Some of the opposing portion pairs 58 are opposing portions of the panels 14 and 16 in the proximity of the connection regions 50. The remainder of the opposing portion pairs 58 are located at the row front 26 and the row back 28. The bending portions 60 are located between the opposing portion pairs 58.

Each opposing portion pair 58 is attached by a set of cross members 62. The set of cross members 62 restrict the opposing portion pairs 58 from moving any further apart than the panel distance 56 at that location. The purpose for the movement restriction is explained below. In the shown embodiment of the invention, the set of cross members 62 is comprised of two rods assemblies 64 that bolt to the respective opposing portion pairs 58. Suitable cross members include rods with female threaded ends, and bars or straps with nuts welded to their ends (not shown). Other embodiments of the invention may have more than two cross members per set. Other embodiments of the invention may use other means for restricting the opposing portion pairs 58 form moving any further apart than the panel distance 56 at that location.

The bending portions 60 of the shown embodiment have bending holes 66 extending therethrough. The bending holes 66 facilitate the bending portions 60 to bend outwardly when a force F is applied to the attenuator 10 in an axial direction. The bending holes 66 are located more specifically at contact regions 68. A contact region 68 is a portion of a bending portion 60 that is in contact with the adjacent hoops 34–40. The contact regions 68 are shown to be midway between adjacent opposing portions. Pull-through bolts 70 connect the contact regions 68 with the adjacent hoops 34–40.

Figure 3:
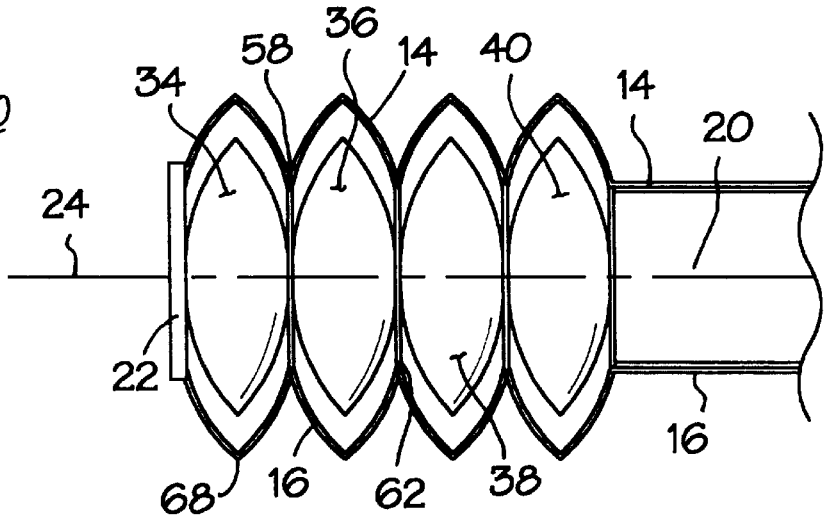
FIG. 3 shows a top view of the attenuator shown in FIG. 1, but with the attenuator compressed.

Referring now to FIG. 3, the attenuator 10 is shown after the force F has been applied to the nose 22 in an axial direction. Each hoop 34–40 has been compressed in the axial direction. Further, the border panels 14 and 16 have deformed into a zig-zag configuration. During the compression of the attenuator, the compressing hoops 34–40 extend radially. As the hoops 34–40 extend, they urge the contact portions 68 of the border panels 14 and 16 radially outward as well. The sets of cross members 62 maintain the opposing portion pairs 58 at a panel distance 56. The distancing of the contact portions 68, combined with maintaining the panel distance 56 of the pairs 58, results in the zig-zag configuration after compression.

Figure 4:
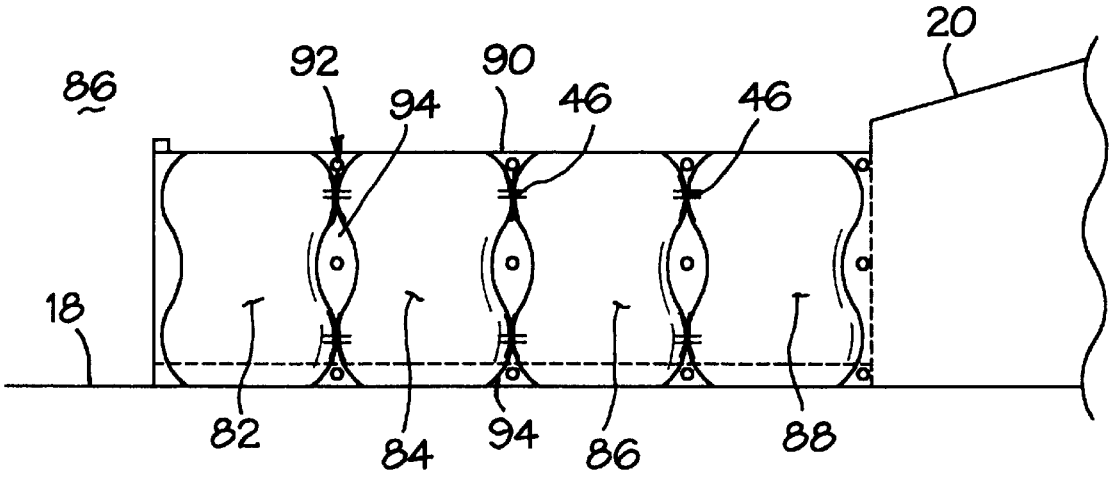
FIG. 4 shows an axial section view of an embodiment of the invention comprised of W-beams.

Referring now to FIG. 4, attenuator 80 is of similar construction as attenuator 10, but for the material used to form hoops 82–88 and side panels. The shown embodiment of the attenuator 80 is an axial cross-section, resulting in only the left side panel 90 being shown. In a preferred, and shown, embodiment of the invention, w-beam guardrails or thrie-beam guardrails are used to fabricate the hoops 82–88 and the side panels. Attenuator 80 shows the sets of three cross members 92 extending through gaps 94 created by the contours of the hoops 82–88.

Figure 5:
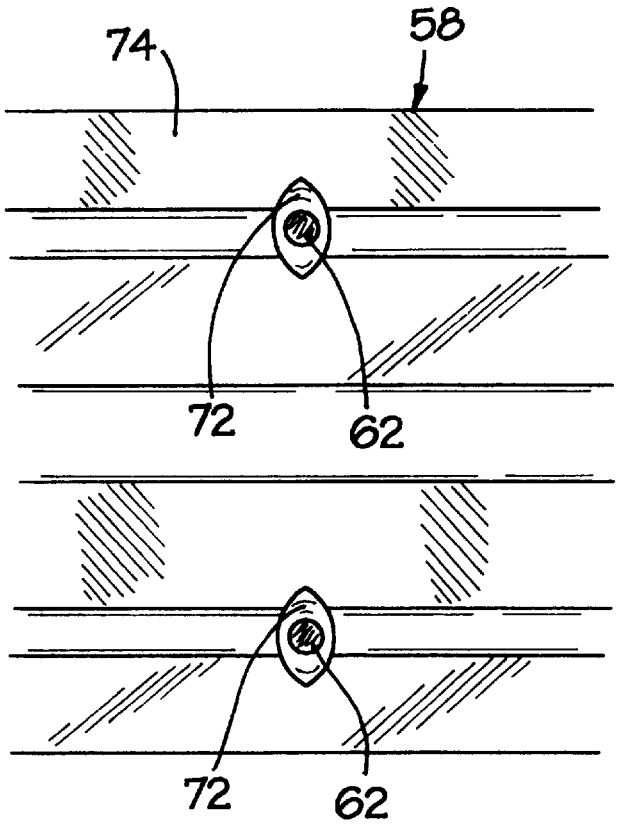
FIGS. 5 and 6 show views of an indented rib used to facilitate bending of a border panel of the attenuator shown in FIG. 4.
Figure 6:
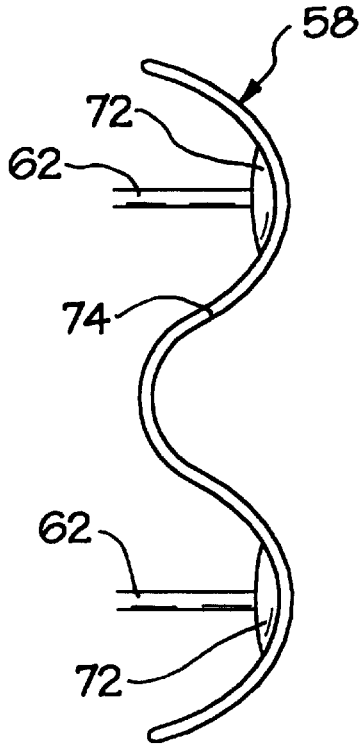

Referring now to FIGS. 5 and 6, the cross members 62 are attached to the opposing pair portion 58 at an indented vertical rib 72. The indented vertical rib 72 is used as means to weaken the opposing pair portion 58 for facilitating bending about the portion. The rib 72 assists in the border panels 14 and 16 attaining the zig-zag configuration after compression (see FIG. 3). Other embodiments of the invention may use other means for weakening the opposing pair portions 58.

Figure 7:
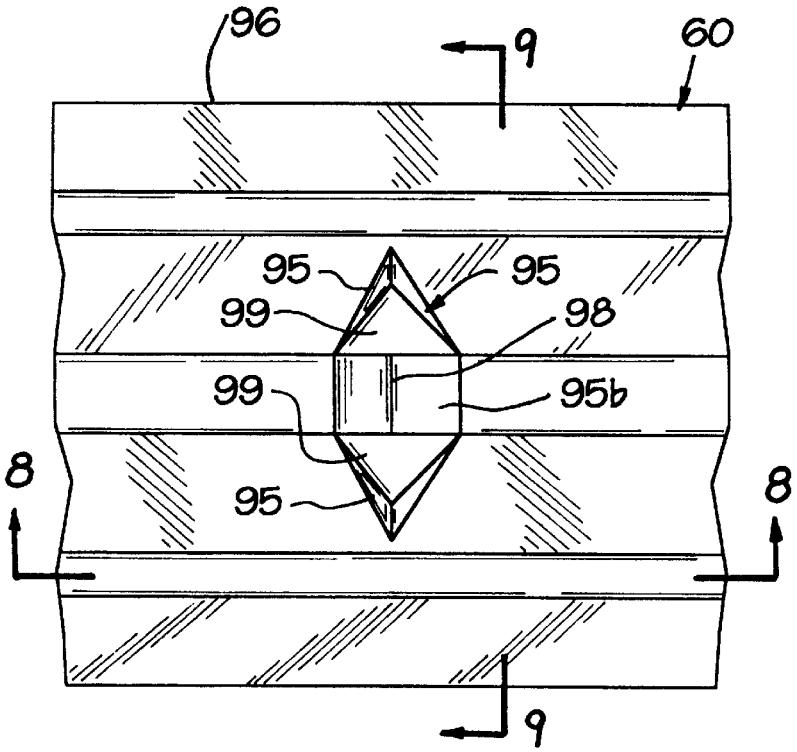
FIGS. 7, 8, and 9 show views of an embossed rib used to facilitate bending of a border panel of the attenuator shown in FIG. 4.
Figure 8:
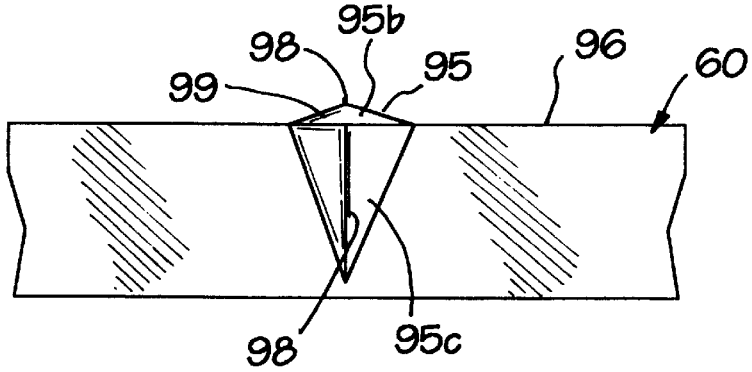
Figure 9:
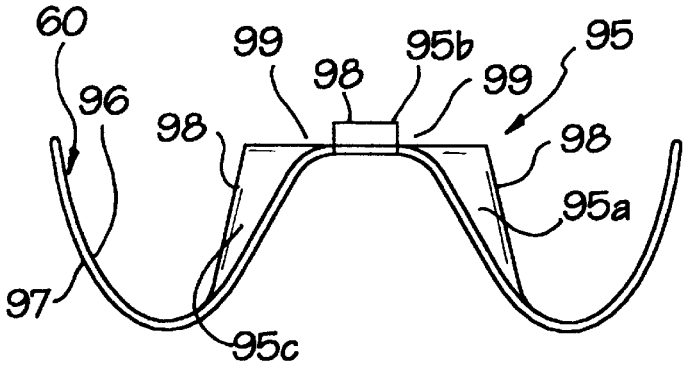

Referring now to FIGS. 7, 8, and 9, in another embodiment of the invention, an embossed vertical rib 95 is used as a means to weaken the bending portion 60 for facilitating outward bending. The embossed vertical rib 95 is embossed on the bending portion 60 such that it extends from an interior surface 96 toward the axis 24 (not shown). The bending portion 60 also has an exterior surface 97. The rib 95 has a vertical crease 98 running down its middle. The rib 95 also has two horizontal slots 99, dividing the rib into three sections 95*a–c*. Other embodiments of the invention may have more or less horizontal slots 99.

Figure 10:
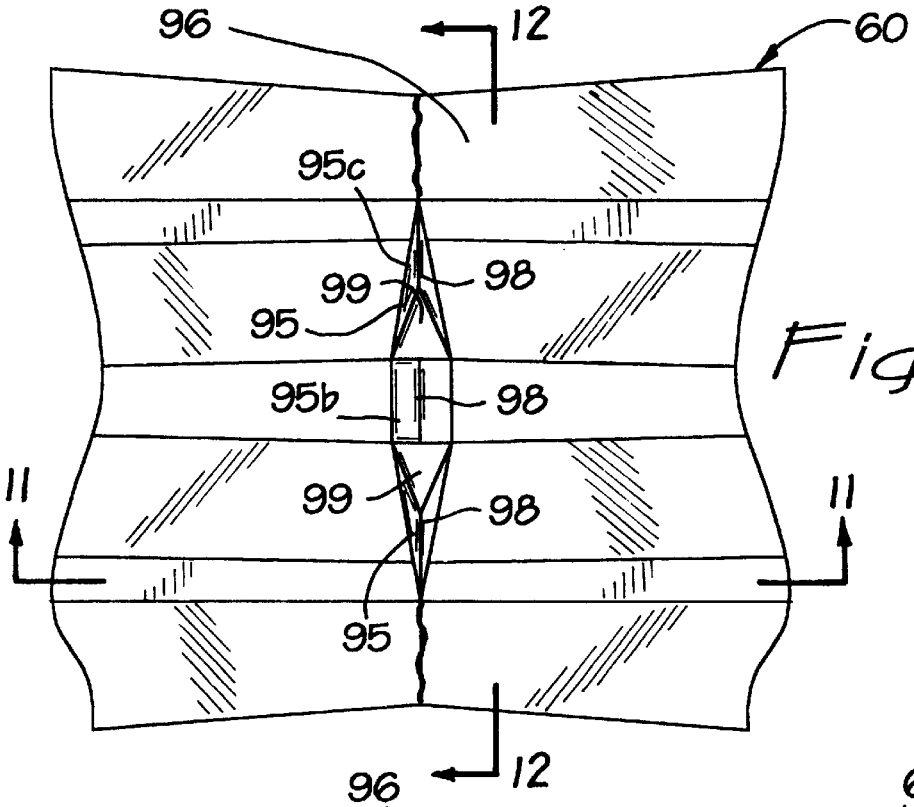
FIGS. 10, 11, and 12 show views of the embossed rib shown in FIGS. 7, 8, and 9 after the bending of the border panel.
Figure 11:
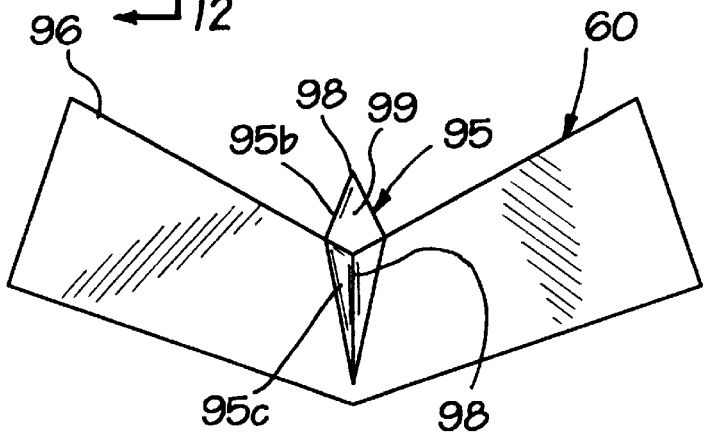
Figure 12:
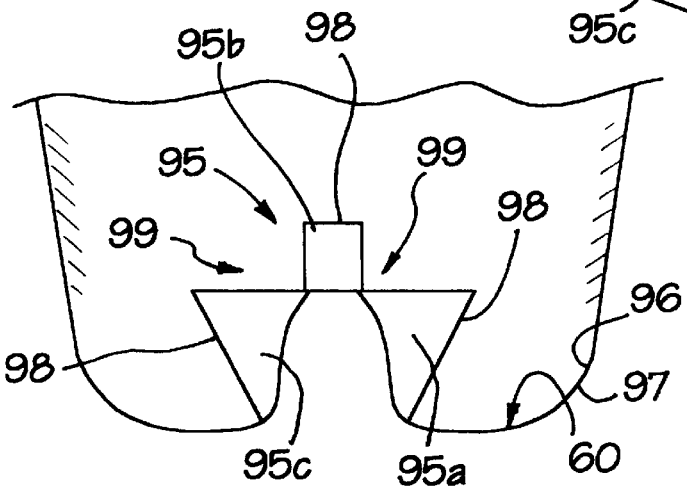

Referring now to FIGS. 10, 11, and 12, details of the rib 95 after bending the bending portion 60 are shown. The rib 95, due to the crease 98 and the horizontal slots 99, is a weakness in the bending portion 60. When the force F is applied (see FIG. 2), the bending portion 60 bends outward at this weakness. FIG. 10 shows the panel 152 bending into the figure. FIG. 11 shows the panel 96 bending downward. The bending causes the rib 95 to narrow, resulting in the three sections 95*a–c* protruding further from the interior surface 96. The horizontal slots 99 also open further. As the bending portion 60 may be in contact with the adjacent hoop (not shown), and the embossed vertical rib 95 extends inwardly, the adjacent hoop may require a hole therethrough to enable the rib to extend through the hoop. Other embodiments of the invention may have other modifications to the panels to create a weakness in the panel and facilitate bending, such as ribs of other configurations, a hole extending through the side panels, such as hole 66 (see FIG. 1), and the like. Embodiments of the invention may not have modifications to the side panels to facilitate bending.

Figure 13:
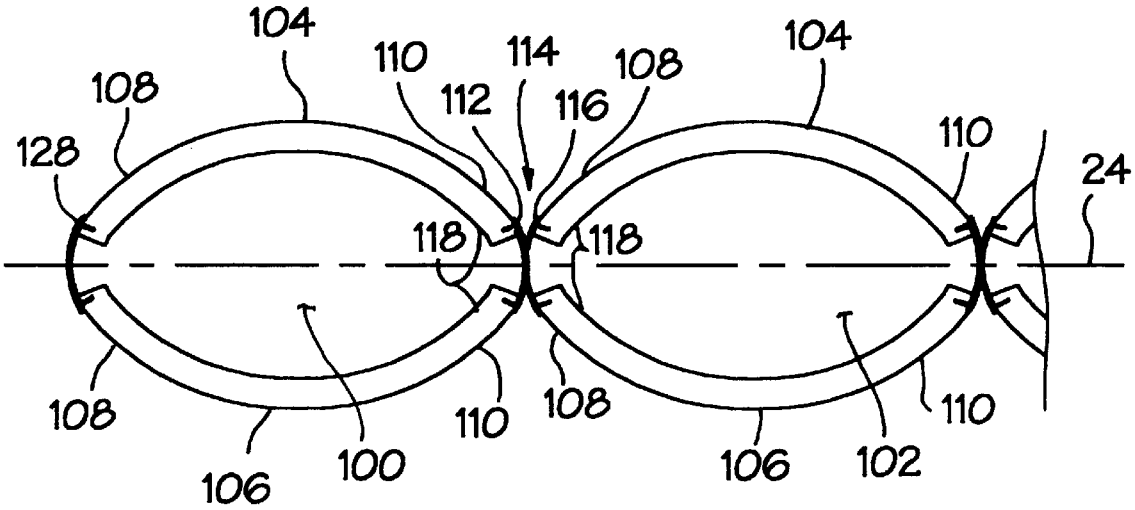
FIG. 13 shows a top view of hoops comprised of two curved panels according to an embodiment of the invention.

Referring now to FIG. 13, in a preferred embodiment of the invention, hoops 100 and 102 comprise left and right outwardly bowing curved panels 104 and 106. FIG. 13 shows an embodiment of the invention using W-beam panels, but other embodiments may use panels of other configurations. The figure shows the left curved panel 104 at the top and the right curved panel 106 at the bottom. The curved panels 104 and 106 have front ends 108 and back ends 110, with the front ends 108 shown on the left and the back ends 110 shown on the right. The front ends 108 are connected together with a first portion 112 of a flexible joint 114. The back ends 110 are connected together with a second portion 116 of a different flexible joint 114. The construction of the flexible joint 114 is described below. The flexible joints 114 enable the interior angles 118 formed by the joined front ends 108 and the joined back ends 110 to enlarge during compression of the hoops 100 and 102.

Figure 14:
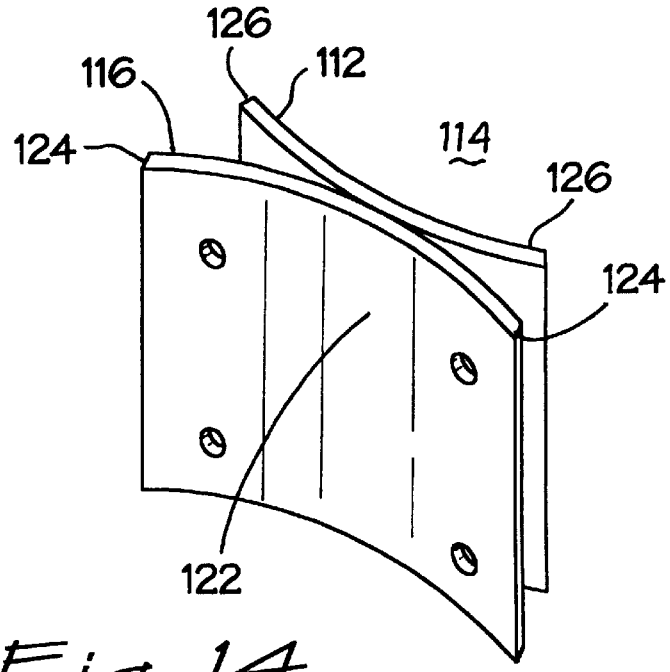
FIG. 14 shows a detail of a two piece flexible joint used in joining the ends of the curved panels shown in FIG. 13.

Referring now to FIG. 14, the flexible joint 114 is comprised of first and second metal plates 112 and 116. The plates 112 and 116 are rectangular and of substantially the same dimensions. The plates 112 and 116 are aligned and welded together at their vertical midlines 122. The plates 112 and 116 are also convexly curved such that the vertical side edges 124 of the plate 112 are distanced from the vertical side edges 126 of the plate 116. The plate 112 is bolted to the back end 110 of hoop 100 and the plate 116 is bolted to the front end 108 of hoop 102. Embodiments of the invention may have more than one flexible joint connecting curved panels 104 and 106. The front ends 108 of hoop 100 has a flexible joint 128 with only one plate as it does not have an adjacent hoop.

Figure 15:
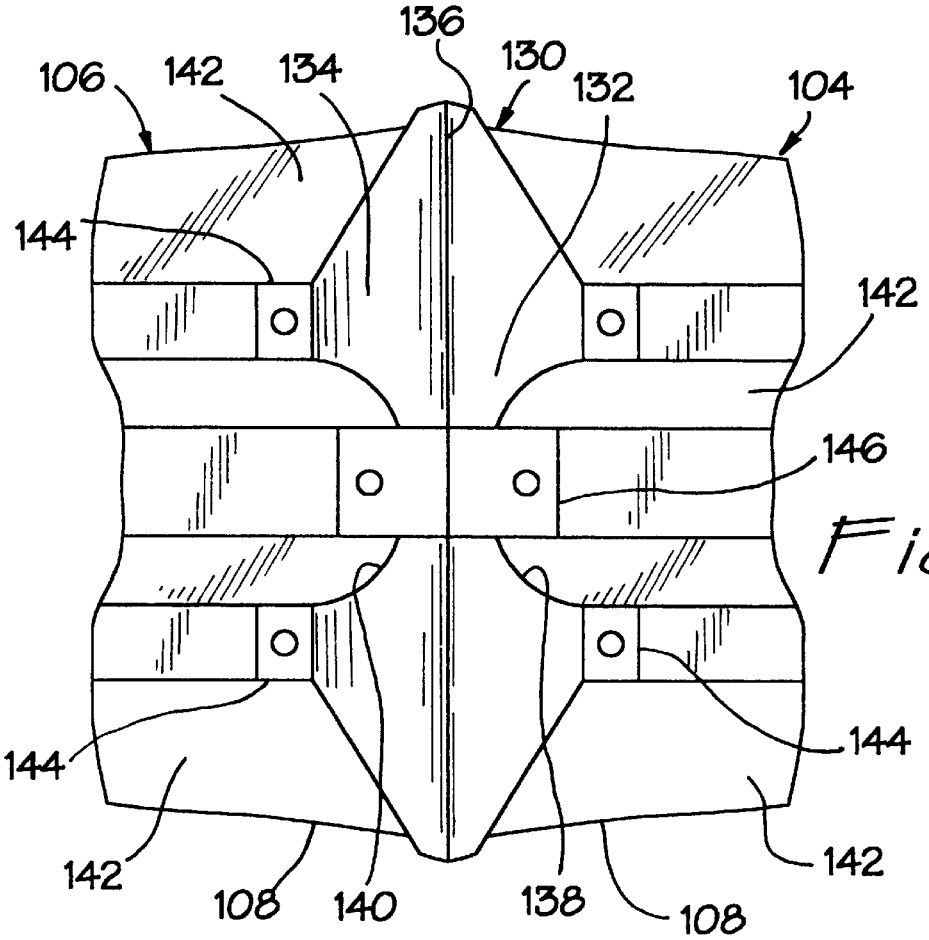
FIG. 15 shows an elevational view of a weldament used to flexibly join the ends of the curved panels shown in FIG. 13.
Figure 16:
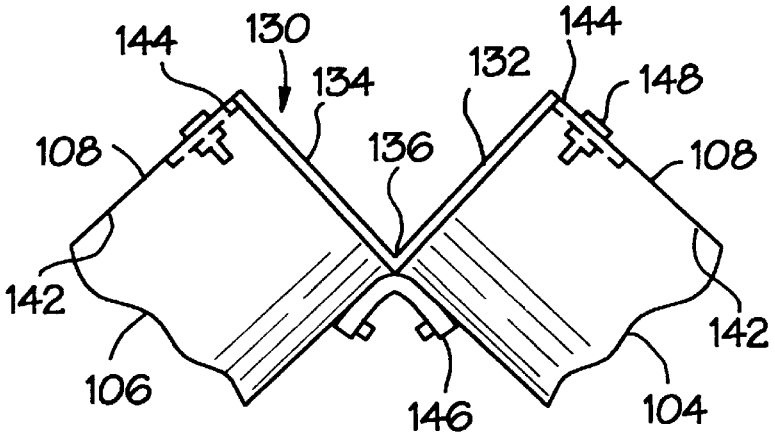
FIG. 16 shows a top view of the weldament shown in FIG. 15.

Referring now to FIGS. 15 and 16, in an embodiment of the invention, a weldament 130 may be used to flexibly attach the ends 108 and 110. The figures show ends 108 being attached with the weldament 130 as an example. The weldament 130 is comprised of two vertical panels 132 and 134 that meet at a vertical corner 136. The panels 132 and 134 have shaped, vertical outer edges 138 and 140 that complement interior surfaces 142 of the curved panels 104 106. The vertical panels 132 and 134 are attached to the curved panels 104 and 106 by side tabs 144 and a center tab 146. The side tabs 144 extend from the edges 138 and 140, are disposed against the curved panels interior surfaces 142, and attach to the curved panels 104 and 106 via bolts 148. Embodiments of the invention may have welds or other attachment means for attaching the side tabs 144 to the side panels 104 and 106. The center tab 146 extends from the vertical corner 136 and is attached to the curved panels 104 and 106 in a similar fashion as the side tabs 58. For adjacent pairs of front ends 108 and pairs of back ends 110, the adjacent weldaments 130 are attached such that the weldaments may flex (not shown). Other devices to flexibly attach the ends are equivalent.

Figure 17:
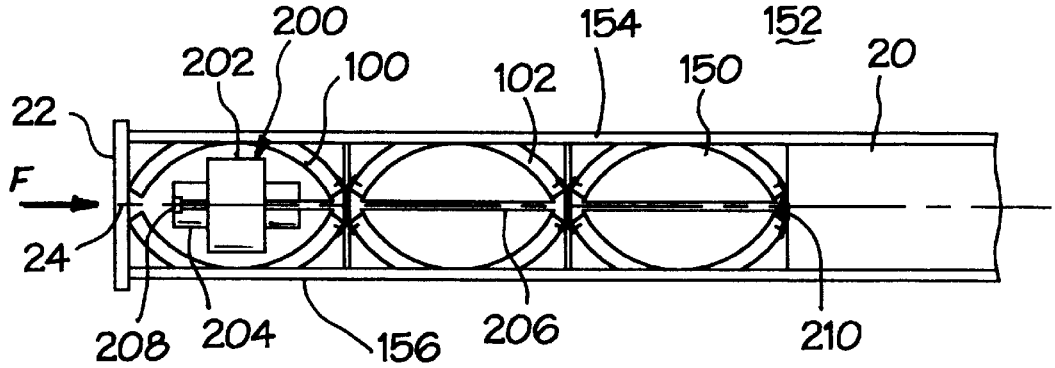
FIGS. 17, 18 and 19 show top views of an attenuator incorporating an axial movement guide with the attenuator having hoops formed from two curved panels.

Referring now to FIG. 17, hoops 100, 102, and 150 are in attenuator 152. The hoop 100 is located adjacent to the nose 22, the hoop 150 is located adjacent the rigid backup 20, and the hoop 102 is located therebetween. Like the hoops 100, 102, and 150, the border panels 154 and 156 are constructed from W-beams, but other suitable materials may be used in other embodiments.

Attenuator 152 has an axial movement guide 200 disposed in the hoop 100. The axial movement guide 200 is comprised of an upper structure 202, a plate 204, and a cable 206. The axial movement guide 200 enables the upper structure to move axially toward the rigid backup 20 when force F is applied to the attenuator 152. The guide 200 also inhibits lateral movement of the attenuator 152. Briefly, the upper structure 202 is slidably mounted to a plate 204 that enables the upper structure to move axially toward the rigid backup 20 when force F is applied to the attenuator 152. The plate 204 is mounted to the surface below the attenuator 152. The cable 206 is stretched along the row axis 24, extending from a cable connector 208 on the plate 204 to the cable connector 210 on the rigid backup 20. The cable 206 guides the upper structure 202 during section compression. Details of the guide 200 are described below in connection with FIG. 20.

Figure 18:
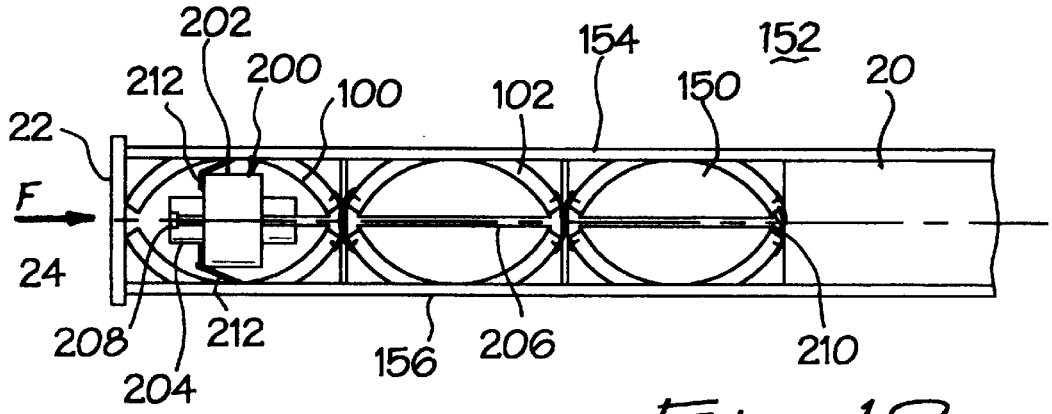

Referring now to FIG. 18, the attenuator 152 has the axial movement guide 200 disposed in hoop 100 and attached to the hoop via mounting members 212. The mounting members 212 are attached to hoop 100 with pull-through bolts (not shown) to enable at least a portion of the members, if not all of the members, to disengage from the hoop during compression. Further details of the mounting members 212 are described below in connection with FIG. 18. Other embodiments of the invention may have other suitable devices to attach the guide 200 to the hoop 100, whether releasably attached or otherwise. Other embodiments of the invention may have the guide 200 disposed in any of the hoops, and the guide may or not be attached to the attenuator 152.

Figure 19:
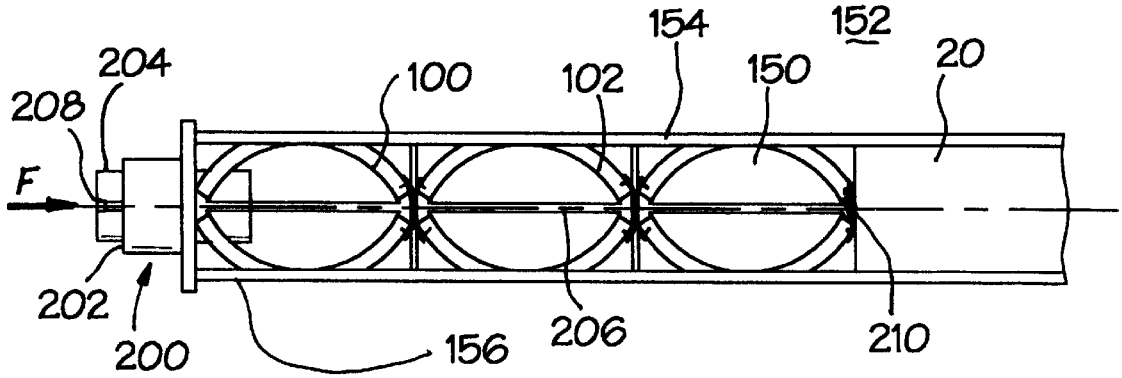

Referring now to FIG. 19, the attenuator 152 has the axial movement guide disposed in front of the nose 22 and attached to the attenuator. Other embodiments of the invention may have the attenuator not attached but merely adjacent to the nose 22. Still further embodiments of the invention may have a nose incorporated into the guide 200 (not shown). Still further embodiments of the invention may have the guide 200 disposed in a stronger structure, for example a stronger hoop, having a higher resistance to compression relative to the other hoops (not shown).

Figure 20:
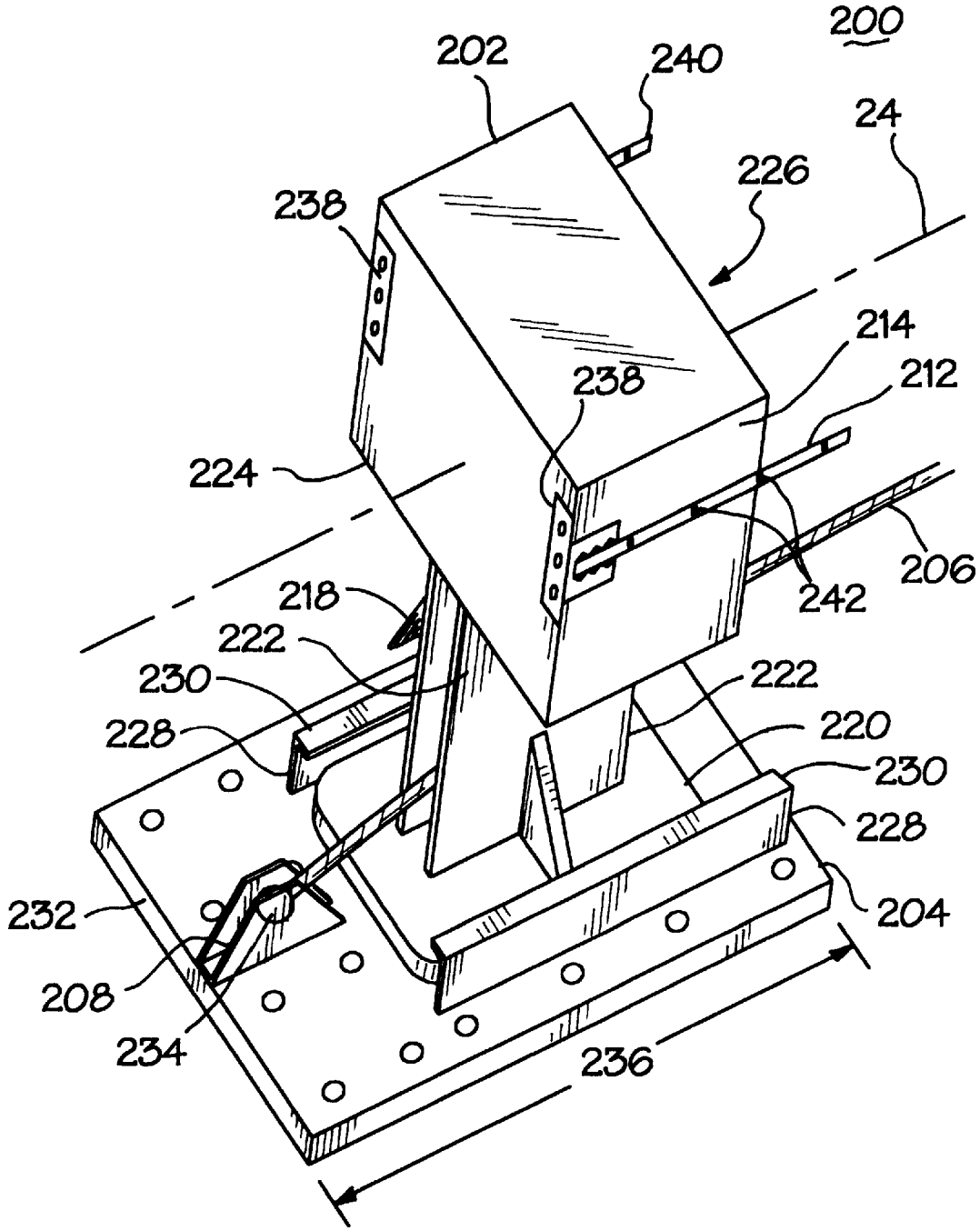
FIG. 20 is a perspective view of the axial movement guide.

Referring now to FIG. 20, the axial movement guide 200 is shown comprising the upper structure 202, the plate 204, the cable 206, the cable connector 208, and the mounting members 212. The length 236 of the plate 204 varies with embodiments. A cable guide 218 descends from the upper structure 202 and terminates at a base 220. The cable guide 218 comprises two vertical panels 222 that are axially oriented and extend from the upper structure front surface 224 to the upper structure back surface 226. The vertical panels 222 straddle the cable 206. The base 220 rests on the plate 204 between two base guides 228. The guides 228 prevent the upper structure 202 from moving laterally. The guides 228 have top lips 230 that over hang the base 220 to prevent the upper structure 202 from tipping over when a lateral force is applied. The cable connector 208 is mounted to the plate front 232 and extends in vertical and axial directions. The cable 206 extends through a hole 234 in the connector 208. The mounting members 212 comprise a front lip 238 that is attached to the upper structure front 224. An axial member 240 extends backwards from the front lip 238. The member 240 has holes 242 extending therethrough for mounting to a hoop with pull-through bolts or other suitable means.

Figure 21:
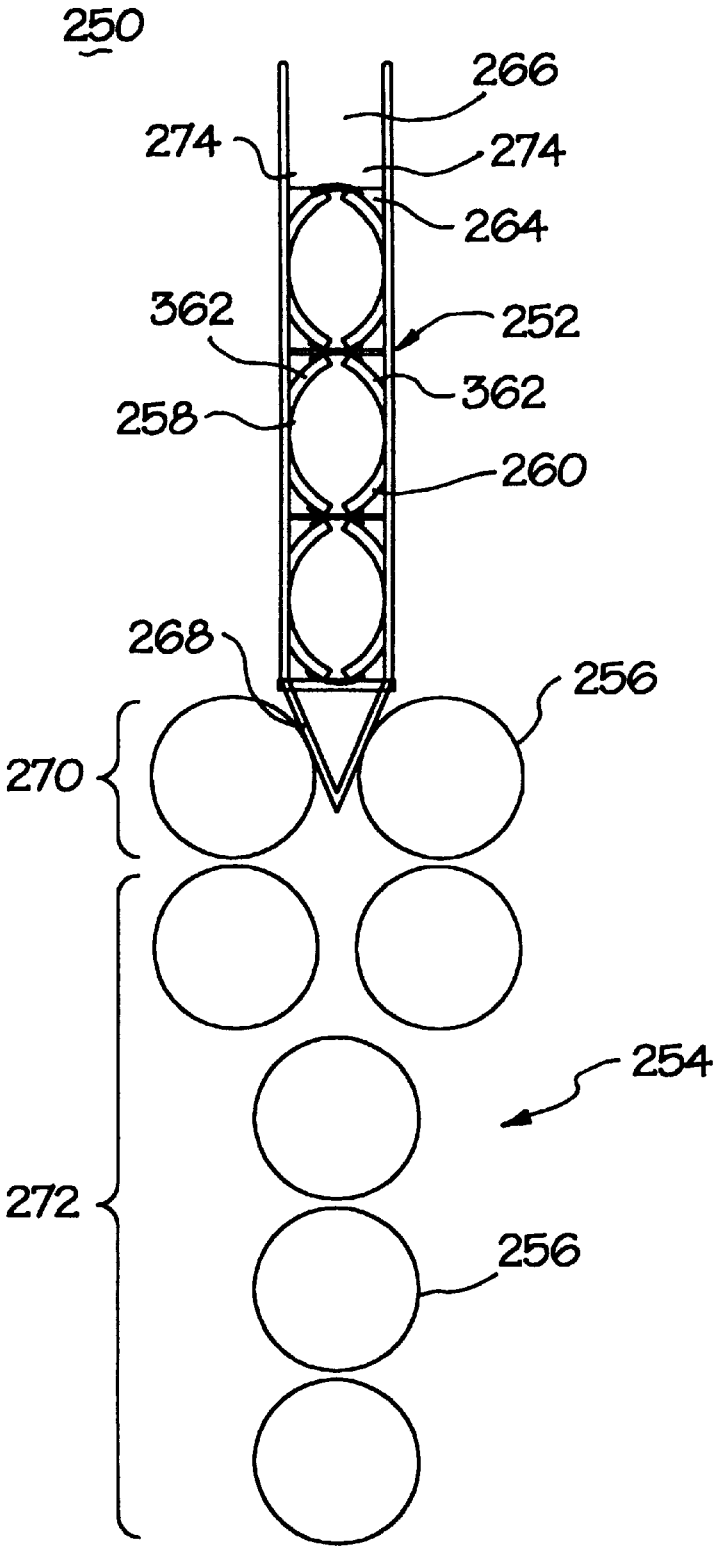
FIG. 21 is a top view of an attenuator system with an attenuator extending into an array of sand barrels according to an embodiment of the invention.

Referring now to FIG. 21, an attenuator system 250 comprises an attenuator 252 and an array 254 of sand barrels 256. The attenuator 252 is comprised of a row 258 of three hoops 260. The hoops 260 are comprised of side panels 362 as shown in FIG. 21. Other embodiments of the invention may use hoops of other configurations. A row back 264 is attached to a rigid backup 266. A row front 268 extends into a first portion 270 of the array 254. A second portion 272 of the array 254 extends from the first portion 270 and away from the row 258.

The combination of the attenuator 252 and the array 254 assists in protecting vehicles from coffin corners 274 of the attenuation system 250. The attenuator 252 performs a redirection function for inhibiting a vehicle (not shown)

from colliding with the coffin corners 274. The array 254 performs the gating function of the system 250 by enabling a vehicle to penetrate through the sand barrels 256. With the pointed front end 268 extending into the array 254, the sand barrels 256 of the first portion 270 provide lateral support to the attenuator 252 during vehicular side impacts. This support is relevant in that the shown embodiment does not have an axial movement guide (See FIG. 20). Other embodiments of the invention may not have a pointed front end 268 and may extend various distances into the array 254. Other embodiments of the invention may have attenuation systems comprising an attenuator, an arrays of sand barrels, and an axial movement guide. Other embodiments of the invention may use any equivalent to the sand barrels 256, such as containers filled with suitable particulate mass. While the shown embodiment has three hoops 260 in the row 258, other embodiments of the invention may have other amounts of hoops or hoops of other configurations.

The present invention may be embodied in other specific forms without departing from its spirit or essential attributes. For example, the row of hoops may comprise any number of hoops and the hoops may be of varying sizes and shapes. The hoops and the border panels may be fabricated from a plurality of pieces and need not be unitary. Accordingly, reference should be made to the appended claims, rather than to the foregoing specification, as indicating the scope of the invention.

What is claimed is:

1. A crash attenuator system, comprising:

a row of two or more hoops, said row of hoops being compressible along a row axis, the row having a row front and a row back intersecting the row axis, and a left side and a right side extending between the row front and the row back, each hoop in said row of hoops being comprised of a right curved outwardly bowing portion and a left curved outwardly bowing portion;

adjacent hoops in said row of hoops being attached together at respective ends thereof;

a left border member extending along at least a portion of the left side of said row of hoops;

a right border member extending along at least a portion of the right side of said row of hoops, wherein the left and right border members are spaced a predetermined distance apart;

wherein the border member structure has been structurally weakened at a weakness location on each of said bending portions to facilitate outward bending of said left and right border members when a hoop enclosed by said border members is compressed;

connection structure which restricts opposing portion pairs of the left and right border members from moving apart any further than said predetermined distance upon compression of one or more of said hoops; and wherein the right curved outwardly bowing portion and the left curved outwardly bowing portion of each hoop bows outwardly a substantially increased amount upon compression of that hoop due to an impact.

2. The crash attenuator system as recited in claim 1, wherein segments of said left and right border members disposed outwardly of each of said hoops include bending portions disposed axially between said opposing portion pairs.

3. The crash attenuator system as recited in claim 2, wherein said bending portion weakness locations include holes for structurally weakening said bending portions.

4. The crash attenuator system as recited in claim 2, wherein said bending portion weakness locations include slots for structurally weakening said bending portions.

5. The crash attenuator system as recited in claim 1, wherein said connection structure comprises one or more sets of one or more cross-members extending between and attaching one or more opposing portion pairs, respectively.

6. The crash attenuator system as recited in claim 1, wherein:

the left and right border members extend from the row front to the row back; and the opposing portion pairs are disposed about the row front, the row back, and attachment regions between said hoops.

7. The crash attenuator system as recited in claim 5, wherein said connection structure comprises rods, bars, or straps.

8. The crash attenuator system as recited in claim 2, wherein the border members comprise contact regions disposed axially midway between opposing portions and the structural weakness locations on said border members are disposed at said contact regions.

9. The crash attenuator system as recited in claim 1, wherein said border members comprise border panels.

10. The crash attenuator system as recited in claim 8, wherein said contact regions comprises one or more embossed ribs extending toward the hoops for structurally weakening said bending portions.

11. The crash attenuator system as recited in claim 8, and further comprising pull-through bolts connecting at least one contact region to an adjacent hoop.

12. The crash attenuator system as recited in claim 1, wherein said adjacent hoops in said row of hoops are attached together at respective proximal ends by flexible joints.

13. The crash attenuator system as recited in claim 1, wherein each hoop has an axial length along the row axis that is longer than a hoop cross-axial length across the row axis.

14. The crash attenuator system as recited in claim 1, wherein each hoop has an axial length along the row axis that is substantially the same as a hoop cross-axial length across the row axis.

15. The crash attenuator system as recited in claim 1, and further comprising a nose disposed proximally of the row front.

16. The crash attenuator system as recited in claim 1, wherein the row back is attached to a rigid backup.

17. The crash attenuator system as recited in claim 16, wherein the rigid backup is portable.

18. The crash attenuator system as recited in claim 16, wherein the left and right border members are attached to left and right sides of the rigid backup.

19. The crash attenuator system as recited in claim 1, and further comprising an axial movement guide comprising:

a guide plate mounted on a surface below the row of hoops; and an upper structure that is slidably mounted in an axial direction to the guide plate and that is attached to the row of hoops.

20. The crash attenuator system as recited in claim 1, and further including an axial movement guide comprising:

a guide plate mounted on a surface below the row of hoops; and an upper structure that is slidably mounted in an axial direction to the guide plate and disposed in one of the hoops.

21. The crash attenuator system as recited in claim 1, and further including an axial movement guide comprising:

a guide plate mounted on a surface below the row of hoops; and an upper structure that is slidably mounted in an axial direction to the guide plate and disposed in front of the row front.

22. The crash attenuator system as recited in claim 1, and further comprising gating structure for permitting controlled penetration by a vehicle, said gating structure comprising a first portion into which the row front extends, and a second portion extending from the first portion and away from the row of hoops along the row axis.

23. The crash attenuator system as recited in claim 22, wherein said gating structure comprises an array of containers holding a particulate ballasting material.

24. A crash ATTENUATOR system, comprising:

a row of two or more hoops, said row of hoops being compressible along a row axis, the row having a row front and a row back intersecting the row axis, and a left side and a right side extending between the row front and the row back, each hoop in said row of hoops being comprised of a right curved outwardly bowing portion and a left curved outwardly bowing portion;

adjacent hoops in said row of hoops being attached together at respective ends thereof;

a left border member extending along at least a portion of the left side of said row of hoops;

a right border member extending along at least a portion of the right side of said row of hoops, wherein the left and right border members are spaced a predetermined distance apart; each of said left and right border members including a bending portion disposed outwardly of respective left and right curved outwardly bowing hoop portions and having a location thereon which is structurally weakened to facilitate outward bending thereof under compression;

wherein the right curved outwardly bowing portion and the left curved outwardly bowing portion of each hoop bows outwardly a substantially increased amount upon compression of that hoop due to an impact.

25. The crash attenuator system as recited in claim 24, wherein said bending portion weakness locations include holes for structurally weakening said bending portions.

26. The crash attenuator system as recited in claim 24, wherein said bending portion weakness locations include slots for structurally weakening said bending portions.

27. The crash attenuator system as recited in claim 24, and further comprising connection structure which restricts opposing portion pairs of the left and right border members from moving apart any further than said predetermined distance upon compression of one or more of said hoops.

28. The crash attenuator system as recited in claim 27, wherein said connection structure comprises one or more sets of one or more cross-members extending between and attaching one or more opposing portion pairs, respectively.

29. The crash attenuator system as recited in claim 27, wherein:

the left and right border members extend from the row front to the row back; and the opposing portion pairs are disposed about the row front, the row back, and attachment regions between said hoops.

30. The crash attenuator system as recited in claim 27, wherein said connection structure comprises rods, bars, or straps.

31. The crash attenuator system as recited in claim 24, wherein the border members comprise contact regions disposed axially midway between opposing portions and the bending portion weakness locations on said border members are disposed at said contact regions.

32. The crash attenuator system as recited in claim 31, wherein said contact regions comprise one or more embossed ribs extending toward the hoops for structurally weakening said bending portions.

33. The crash attenuator system as recited in claim 24, wherein said adjacent hoops in said row of hoops are attached together at respective proximal ends by flexible joints.

34. The crash attenuator system as recited in claim 24, wherein each hoop has an axial length along the row axis that is longer than a hoop cross-axial length across the row axis.

35. The crash attenuator system as recited in claim 24, wherein each hoop has an axial length along the row axis that is substantially the same as a hoop cross-axial length across the row axis.

36. The crash attenuator system as recited in claim 24, and further comprising a nose disposed proximally of the row front.

37. The crash attenuator system as recited in claim 24, wherein the row back is attached to a rigid backup.

38. The crash attenuator system as recited in claim 37, wherein the rigid backup is portable.

39. The crash attenuator system as recited in claim 37, wherein the left and right border members are attached to left and right sides of the rigid backup.

40. The crash attenuator system as recited in claim 24, and further comprising an axial movement guide comprising:

a guide plate mounted on a surface below the row of hoops; and an upper structure that is slidably mounted in an axial direction to the guide plate and that is attached to the row of hoops.

41. The crash attenuator system as recited in claim 24, and further including an axial movement guide comprising:

a guide plate mounted on a surface below the row of hoops; and an upper structure that is slidably mounted in an axial direction to the guide plate and disposed in one of the hoops.

42. The crash attenuator system as recited in claim 24, and further including an axial movement guide comprising:

a guide plate mounted on a surface below the row of hoops; and an upper structure that is slidably mounted in an axial direction to the guide plate and disposed in front of the row front.

43. The crash attenuator system as recited in claim 24, and further comprising gating structure for permitting controlled penetration by a vehicle, said gating structure comprising a first portion into which the row front extends, and a second portion extending from the first portion and away from the row of hoops along the row axis.

44. The crash attenuator system as recited in claim 43, wherein said gating structure comprises an array of containers holding a particulate ballasting material.

* * * * *